US008127493B2

(12) United States Patent
Cappelli et al.

(10) Patent No.: US 8,127,493 B2
(45) Date of Patent: Mar. 6, 2012

(54) MECHANISM FOR ADJUSTING MOUNTING POSITION OF WINDOW REGULATOR

(75) Inventors: Mario Cappelli, San Giuliano Terme (IT); Paolo Tempestini, Livorno (IT)

(73) Assignee: Magna Closures S.p.A., Collesalvetti (IT)

( * ) Notice: Subject to any disclaimer, the term of this patent is extended or adjusted under 35 U.S.C. 154(b) by 359 days.

(21) Appl. No.: 12/471,641

(22) Filed: May 26, 2009

(65) Prior Publication Data

US 2009/0288345 A1 Nov. 26, 2009

Related U.S. Application Data

(60) Provisional application No. 61/056,025, filed on May 26, 2008.

(51) Int. Cl.
*E05D 15/10* (2006.01)

(52) U.S. Cl. ..... 49/212

(58) Field of Classification Search ..... 49/212, 49/348, 349

See application file for complete search history.

(56) References Cited

U.S. PATENT DOCUMENTS

| | | | | |
|---|---|---|---|---|
| 3,703,053 | A | 11/1972 | De Rees | |
| 4,761,915 | A * | 8/1988 | Marz | 49/374 |
| 4,956,942 | A * | 9/1990 | Lisak et al. | 49/502 |
| 5,201,144 | A | 4/1993 | Krajenke | |
| 5,430,976 | A * | 7/1995 | Wirsing | 49/452 |
| 5,622,005 | A | 4/1997 | Ochenski | |
| 5,855,095 | A * | 1/1999 | Dedrich et al. | 49/502 |
| 5,927,021 | A * | 7/1999 | Kowalski et al. | 49/502 |
| 5,960,588 | A * | 10/1999 | Wurm et al. | 49/352 |
| 6,425,208 | B1 * | 7/2002 | Klueger et al. | 49/502 |
| 6,598,345 | B1 | 7/2003 | Arimoto | |
| 7,246,464 | B2 * | 7/2007 | Castellon | 49/212 |
| 7,467,494 | B2 * | 12/2008 | Buchta | 49/352 |
| 2007/0294950 | A1 | 12/2007 | Allen | |

FOREIGN PATENT DOCUMENTS

| | | | |
|---|---|---|---|
| DE | 100 14 946 | A1 * | 9/2001 |
| EP | 626283 | A1 * | 11/1994 |

* cited by examiner

*Primary Examiner* — Jerry Redman
(74) *Attorney, Agent, or Firm* — Millman IP

(57) ABSTRACT

A window regulator having a rail (20) with a mounting hole (24). A bracket (30) is mountable to a vehicle door. The bracket (30) has a cam guiding feature (38) and a surface (34) for seating the rail (20). The seating surface (34) has an elongate slot (36) therein. A cam (40) having a keyhole (42) and a cam surface (44) engages the cam guiding feature (38) of the bracket (30). A fastener (50) has a shaft fitted through the rail mounting hole (24), cam keyhole (42) and elongate slot (36) and connects the rail (20), cam (40) and bracket (30). The fastener has a key (54) mating with the cam keyhole (42). Thus, rotation of the shaft causes rotation of the cam and a coincident translation of the rail.

3 Claims, 2 Drawing Sheets

MECHANISM FOR ADJUSTING MOUNTING POSITION OF WINDOW REGULATOR

This application claims the benefits of U.S. Provisional application No. 61/056,025, filed May 26, 2008.

BACKGROUND OF THE INVENTION

Due to manufacturing tolerances, it is often necessary to adjust the mounting position of a window regulator inside of a vehicle door, particularly in the cross-car direction. The invention provides a simple, inexpensive mechanism enabling the installer or repair technician to easily adjust the position of a window regulator in a vehicle door.

SUMMARY OF INVENTION

According to one aspect of the invention a window regulator assembly is provided which includes a window regulator having a rail. The rail has a mounting hole. A bracket, which is mountable to a vehicle door, includes a cam guiding feature and a surface for seating the rail. The seating surface has an elongate slot therein. A preferably eccentric cam engages the cam guiding feature of the bracket. The cam has a keyhole, and a fastener is fitted through the rail mounting hole, cam keyhole and elongate slot to connect the rail, cam and bracket. The fastener has a key mating with the cam keyhole, thus coupling the fastener to the cam. Rotation of the fastener causes rotation of the cam and a coincident translation of the rail.

DESCRIPTION OF THE PREFERRED EMBODIMENT

Figure 1:
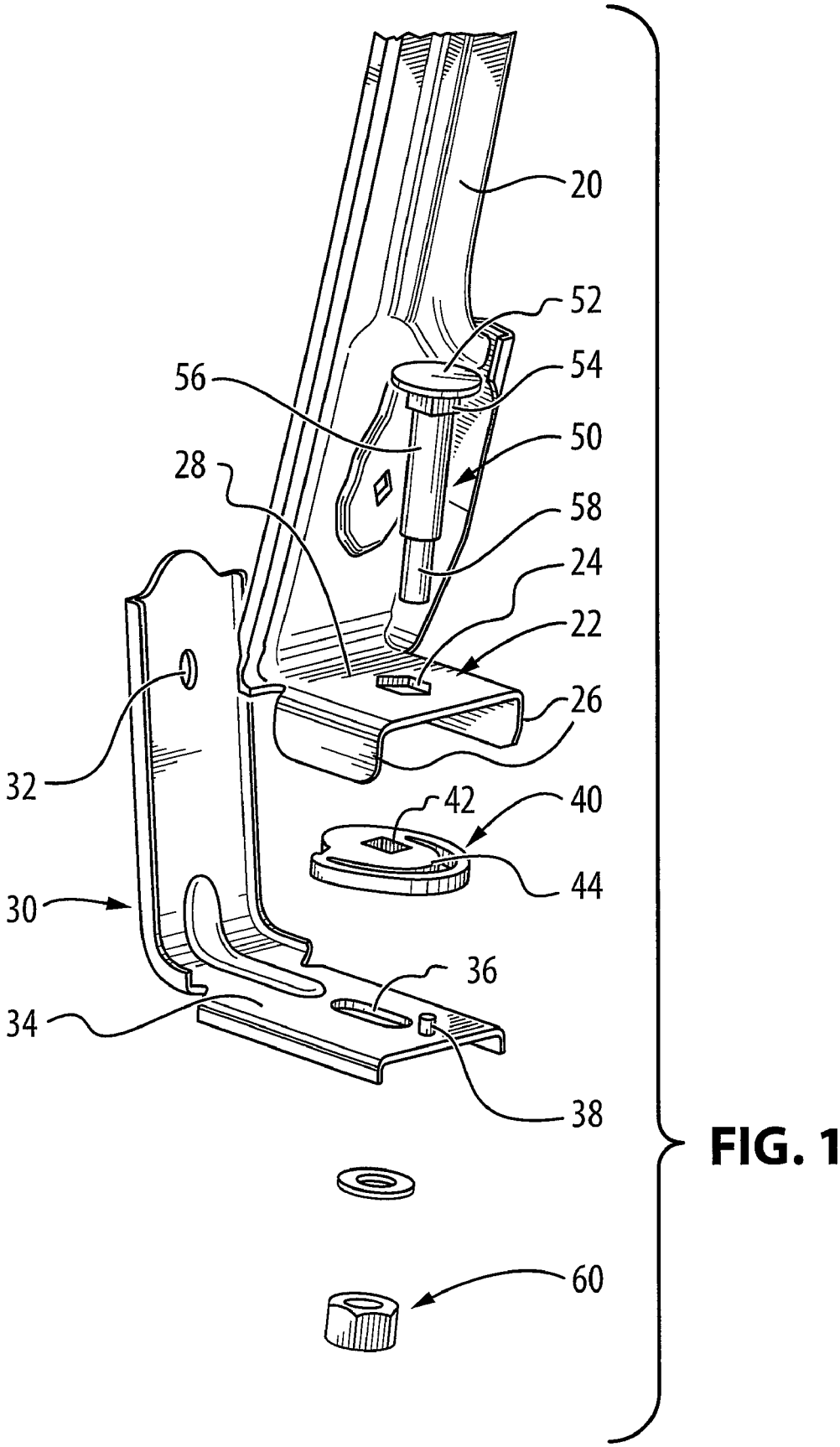
FIG. 1 is an exploded view of a window regulator adjustment mechanism according to a preferred embodiment of the invention.

Referring to the exploded view of FIG. 1, a window regulator as known in the art comprises a rail 20. In the preferred embodiment, the bottom of the rail 20 includes a flange 22 extending outward from the planer body of the rail. The flange 22 includes a hole 24. The flange 22 also preferably includes two wings 26 which, together with a planar surface 28 of the flange, provide a C-shaped channel. It will be appreciated that the rail 20 can be readily formed by known stamping methods.

A bracket 30 is fixedly mounted to the vehicle door via a fastener such as a screw. Hole 32 is provided for this purpose. The bracket 30 is in the form of a right angle and has a planar mounting surface 34 for mounting the rail. The C-shaped channel provided by the rail 20 is sized to closely fit over the mounting surface 34 of the bracket 30. The wings 26 prevent the rail from turning or twisting.

An elongate slot 36 is provided in mounting surface 34. The longitudinal axis of the elongate slot 36 preferably extends in the cross-car direction of the vehicle when the bracket 30 is mounted to the vehicle door. The mounting surface 34 includes a cam guiding feature such as a small nub 38, which projects from mounting surface 34 near an edge of the elongate slot 36.

An eccentric cam 40 is disposed between mounting surface 34 of bracket 30 and flange 22 of rail 20. The cam 40 includes a central keyhole 42 and a spiral slot 44, which has a varying radial distance to the centre of the keyhole 42. When assembled, the eccentric cam 40 is positioned so that the keyhole 42 is axially aligned with the hole 24 of the rail 20 and the elongate slot 36 of bracket 30. In addition, the spiral slot 44 is positioned to interact with the nub 38.

A fastener comprising bolt 50 and nut 60 connects the rail 20, cam 40 and bracket 30 together. The bolt 50 is fitted through hole 24, keyhole 42 and slot 36, thus connecting the rail 20 to the bracket 30 and cam 40. The bolt 50 includes a flat head 52, a key portion 54, a cylindrical portion 55, a threaded portion 56, and a shaft 58, which is preferably also keyed. When installed, the key portion 54 of the bolt 50 seats into the keyhole 42 of the cam 40, over (but not through) the elongate slot 36. (In the illustrated embodiment, the key portion 54 and keyhole 42 are square in shape.) The threaded portion 56 and shaft 58 of the bolt 50 extend through the slot 36. The cylindrical portion 55 rides in the slot 36. The nut 60 mounts onto the threaded portion 56 of the bolt 50 and secures the assembly.

In operation, the nut 60 is loosely tightened (i.e. tightened enough to hold the assembly together but not so tight as to prohibit relative movement of the parts as next described) on the bolt 50. Using a tool coupled to the keyed shaft 58, the operator may then cause the bolt 50 rotate. As the bolt 50 is coupled to the cam 40, the cam is thus caused to rotate. The rotation of the cam 40 causes a coincident translation of the cam 40 and rail 20 along the longitudinal axis of elongate slot 36 due to the eccentric nature of the spiral slot 44 reacting to the fixed nub 38 and the constraint of the bolt 50 which is free to move only within the confines of the elongate slot 36. Once the rail 20 is adjusted to its desired position, the nut 60 may be fully tightened.

Figure 2:
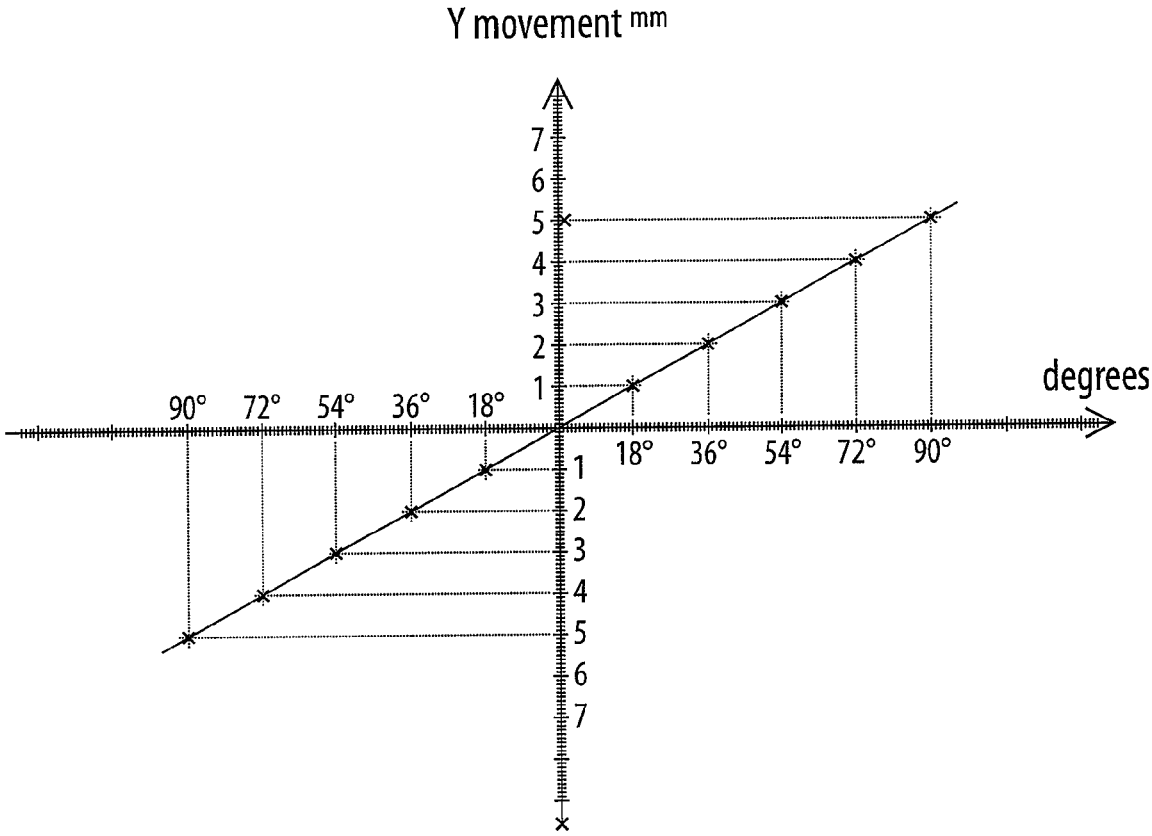
FIG. 2 is a graph showing the relationship between turning angle and linear translation, according to the preferred embodiment.

FIG. 2 shows the relationship between the turning angle of the bolt 50/cam 40 and the resulting linear translation, according to one embodiment of the invention.

We claim:

1. A window regulator assembly, comprising:

a window regulator including a rail (20) having a mounting hole (24);

a bracket (30) mountable to a vehicle door, the bracket (30) having a cam guiding feature (38) and a surface (34) for seating the rail (20), the seating surface (34) having an elongate slot (36) therein;

a cam (40) having a keyhole (42) and a cam surface (44) engaging the cam guiding feature (38) of the bracket (30); and a fastener (50) having a shaft fitted through the rail mounting hole (24), cam keyhole (42) and elongate slot (36) and connecting the rail (20), cam (40) and bracket (30), the fastener having a key (54) mating with the cam keyhole (42);

wherein rotation of the shaft causes rotation of the cam and a coincident translation of the rail.

2. The assembly according to claim 1, wherein the cam surface is eccentric relative to the cam keyhole.

3. The assembly according to claim 2, wherein the cam guiding feature is a nub projecting from the mounting surface, and the cam includes a spiral slot interacting with the nub.

* * * * *